US006672557B1

(12) United States Patent
Jackson

(10) Patent No.: US 6,672,557 B1
(45) Date of Patent: Jan. 6, 2004

(54) LAPTOP COMPUTER SUPPORT BOARD WITH LAMP

(76) Inventor: Edward Jackson, 7810 Red Finch Ct., Humble, TX (US) 77396

( * ) Notice: Subject to any disclaimer, the term of this patent is extended or adjusted under 35 U.S.C. 154(b) by 0 days.

(21) Appl. No.: 10/237,353

(22) Filed: Sep. 9, 2002

(51) Int. Cl.[7] ..... A47B 97/04; A47B 19/00

(52) U.S. Cl. ..... 248/451; 248/917; 248/918; 248/441.1; 108/23; 362/98

(58) Field of Search ..... 248/451, 441.1, 248/447.1, 917, 918, 126, 453, 452; 362/98; 108/23

(56) References Cited

U.S. PATENT DOCUMENTS 3,381,122 A * 4/1968 Boyle, Jr. ..... 362/99
4,053,133 A * 10/1977 Kauffman ..... 248/452
4,159,871 A * 7/1979 Arnone ..... 396/657
4,700,634 A * 10/1987 Mills et al. ..... 108/43
4,751,620 A * 6/1988 Wright et al. ..... 362/99
4,957,264 A * 9/1990 Hakanen ..... 248/510
5,025,353 A * 6/1991 Menaged ..... 362/98
5,553,824 A * 9/1996 Dutra, Jr. ..... 248/346.07
5,623,869 A * 4/1997 Moss et al. ..... 108/43
6,259,601 B1 * 7/2001 Jaggers et al. ..... 361/690
6,466,438 B1 * 10/2002 Lim ..... 361/687
6,491,268 B1 * 12/2002 Channer et al. ..... 248/176.1
6,491,276 B1 * 12/2002 Belliveau ..... 248/372.1

* cited by examiner

*Primary Examiner*—Kimberly Wood
(74) *Attorney, Agent, or Firm*—Goldstein & Lavas, P.C.

(57) ABSTRACT

A laptop computer support board with lamp for supporting a laptop computer and providing light over the computer. The device has a support board on which the keyboard bottom surface rests, a lamp assembly, and a vent portion for allowing dispersion of the heat emitted from the computer. The support board has stoppers secured to the board top surface for wedging the computer in place. The vent portion is positioned between the stoppers, having venting holes extending through the board, and a raised platform extending upward from the board top surface. The lamp assembly is secured to the board top surface and is adjustable and collapsible. Once collapsed, a lamp cover may be placed over the lamp assembly.

7 Claims, 4 Drawing Sheets

LAPTOP COMPUTER SUPPORT BOARD WITH LAMP

BACKGROUND OF THE INVENTION

The invention relates to a laptop computer support board with lamp. In particular, the invention is a support board on which a laptop computer may rest while in use. The board is equipped with a lamp having an adjustable neck for illuminating the laptop computer.

In the age of computers, laptop computers have become increasingly popular because of the convenience they afford users. The laptop computer is lightweight and compact, thereby enabling it to be carried and used practically anywhere.

When the laptop computer is used at night or in a dark area, the light given off by the computer screen is not enough by which to work and see the keyboard. Besides making it difficult to see the keyboard, working with insufficient light can cause a strain on the user's eyes.

Further, as the name suggests, laptop computers are typically placed on the user's legs while in use. The heat given off by the computer can cause an uncomfortable work environment for the user.

Thus, there exists a need for a laptop computer support board with an integral lamp. The support provides a stable work space on which to place the computer, as well as providing adequate ventilation for the heat emitted by the computer. The support is equipped with a lamp that may be adjusted to shine directly over the computer keyboard. Thus, the user is afforded adequate light by which to work, without having to disturb anyone.

U.S. Pat. No. 5,623,869 to Moss et al. discloses a laptop table for portable computers. While the laptop table disclosed provides a support for the computer, the Moss reference fails to teach an overhead lamp to provide light by which a user may work.

U.S. Pat. No. 4,700,634 to Mills discloses a lap-oriented portable desk unit and U.S. Pat. No. 5,979,337 to Clark et al. discloses a portable three-way desk. Although these references provide lamps incorporated into the desks, because of the construction of said desks, they would not be useful for a laptop computer. The desks each have a storage unit on the underside, thereby providing no ventilation for a computer.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved laptop computer support board with lamp. As such, the general purpose of the present invention, which will be described subsequently in greater detail, is to provide a new and improved laptop computer support board with lamp which has all the advantages of the prior art and none of the disadvantages.

To attain this, the present invention essentially comprises a laptop computer support board with lamp for supporting a laptop computer and providing light over the computer. The device has a support board on which the keyboard bottom surface rests, a lamp assembly, and a vent portion for allowing dispersion of the heat emitted from the computer. The support board has removable stoppers secured to the board top surface for raising and wedging the computer in place. The vent portion is positioned between the stoppers, having venting holes extending through the board, and a raised platform extending upward from the board top surface. The lamp assembly is secured to the board top surface and is adjustable and collapsible. Once collapsed, a lamp cover may be placed over the lamp assembly.

It is an object of the invention to produce a laptop computer support board with lamp for providing a support board on which the computer may be rested while in use. Accordingly, the device has a support board having a plurality of stoppers spaced along the board for wedging the computer in place.

It is a further object of the invention to produce a laptop computer support board with lamp for providing light over the computer while in use yet easily storable when not in use. Accordingly, the lamp assembly is adjustable and collapsible. Further, a lamp cover may be selectively positioned over the collapsible lamp assembly.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
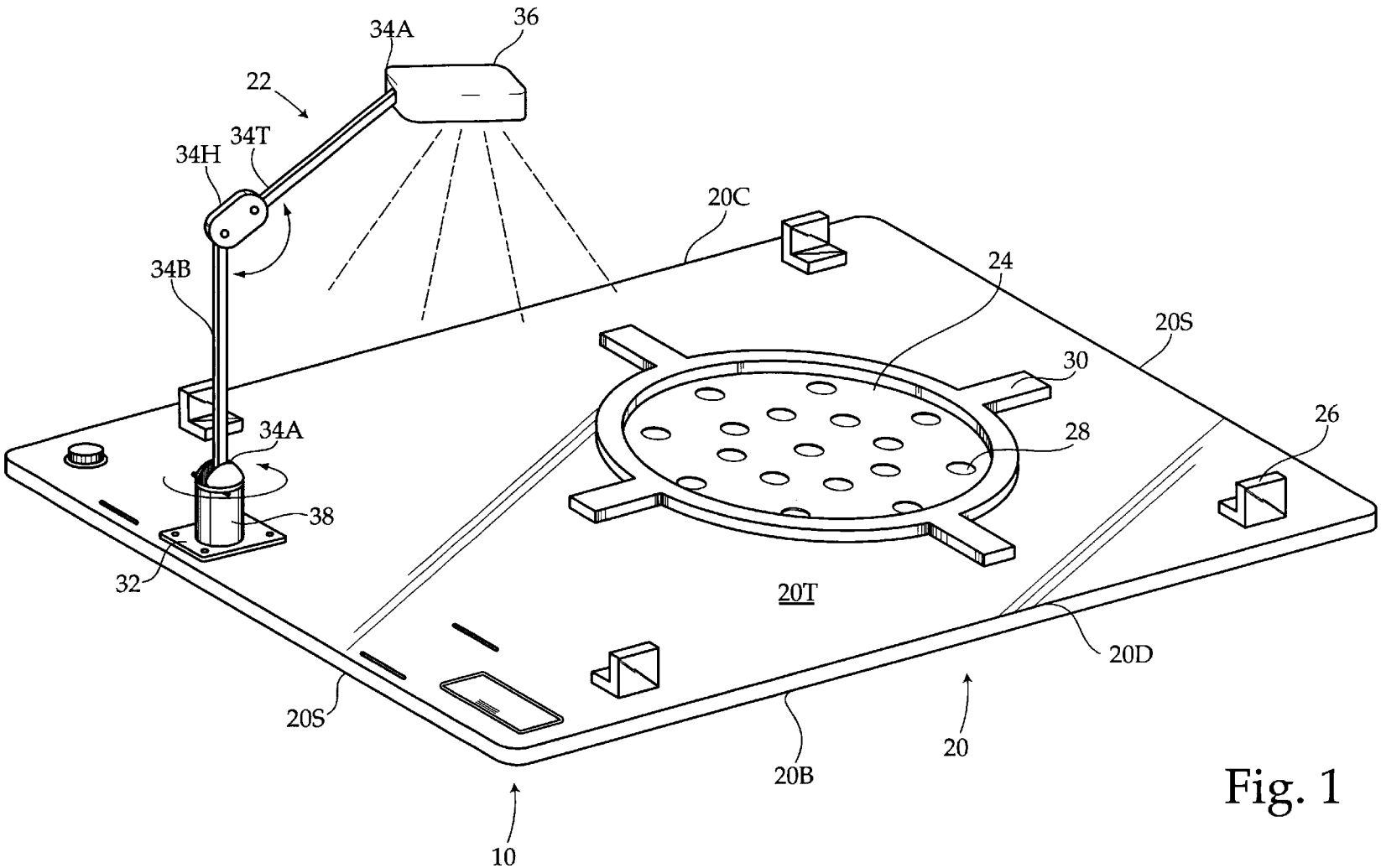
FIG. 1 is a perspective view of the laptop computer support board with lamp, illustrating the adjustability of the lamp assembly.
Figure 2:
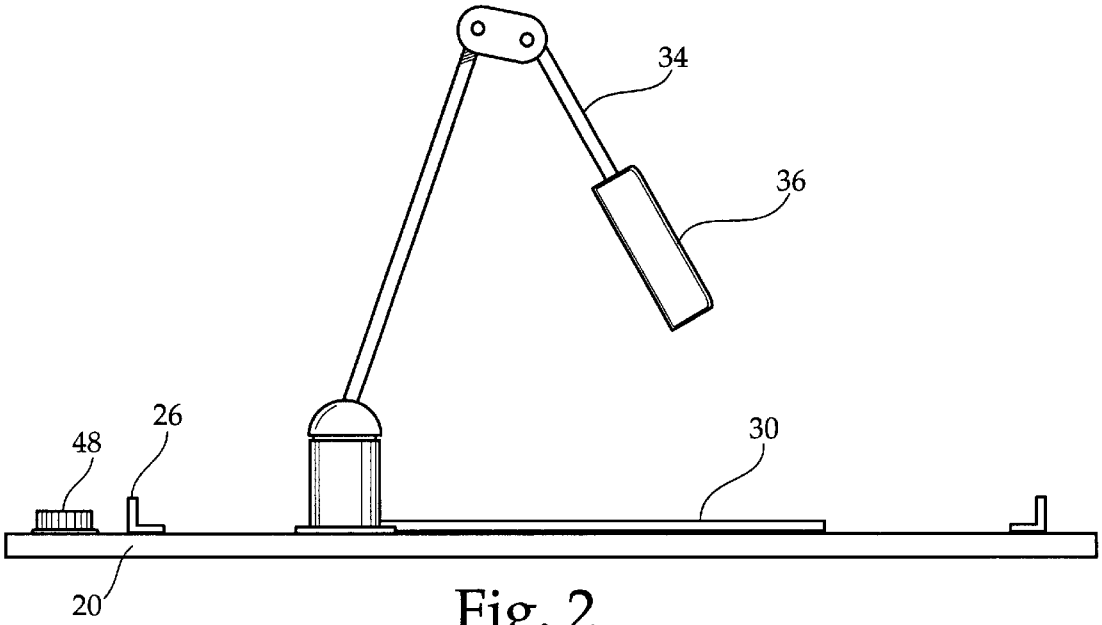
FIG. 2 is a side elevational view of the support board with lamp.

| REFERENCE NUMERALS | |
|---|---|
| 10 | laptop computer support board with lamp |
| 14 | laptop computer |
| 16 | computer screen portion |
| 18 | computer keyboard portion |
| 18T | keyboard portion top surface |
| 18B | keyboard portion bottom surface |
| 20 | support board |
| 20T | support board top surface |
| 20B | support board bottom surface |
| 20C | support board top edge |
| 20D | support board bottom edge |
| 20S | support board side edge |
| 22 | lamp assembly |
| 24 | vent portion |
| 26 | stopper |
| 28 | venting hole |
| 30 | raised platform |
| 32 | lamp mounting plate |
| 34 | lamp arm |

-continued

| REFERENCE NUMERALS | |
|---|---|
| 34A | lamp arm end |
| 34H | lamp arm hinge |
| 34T | lamp arm top portion |
| 34B | lamp arm bottom portion |
| 36 | lamp light fixture |
| 38 | lamp swivel base |
| 40 | lamp cover |
| 40B | lamp cover bottom edge |
| 42 | slot |
| 44 | flange |
| 46 | battery compartment |
| 48 | lamp assembly power button |

DETAILED DESCRIPTION OF THE PREFERRED EMBODIMENTS

Figure 5:
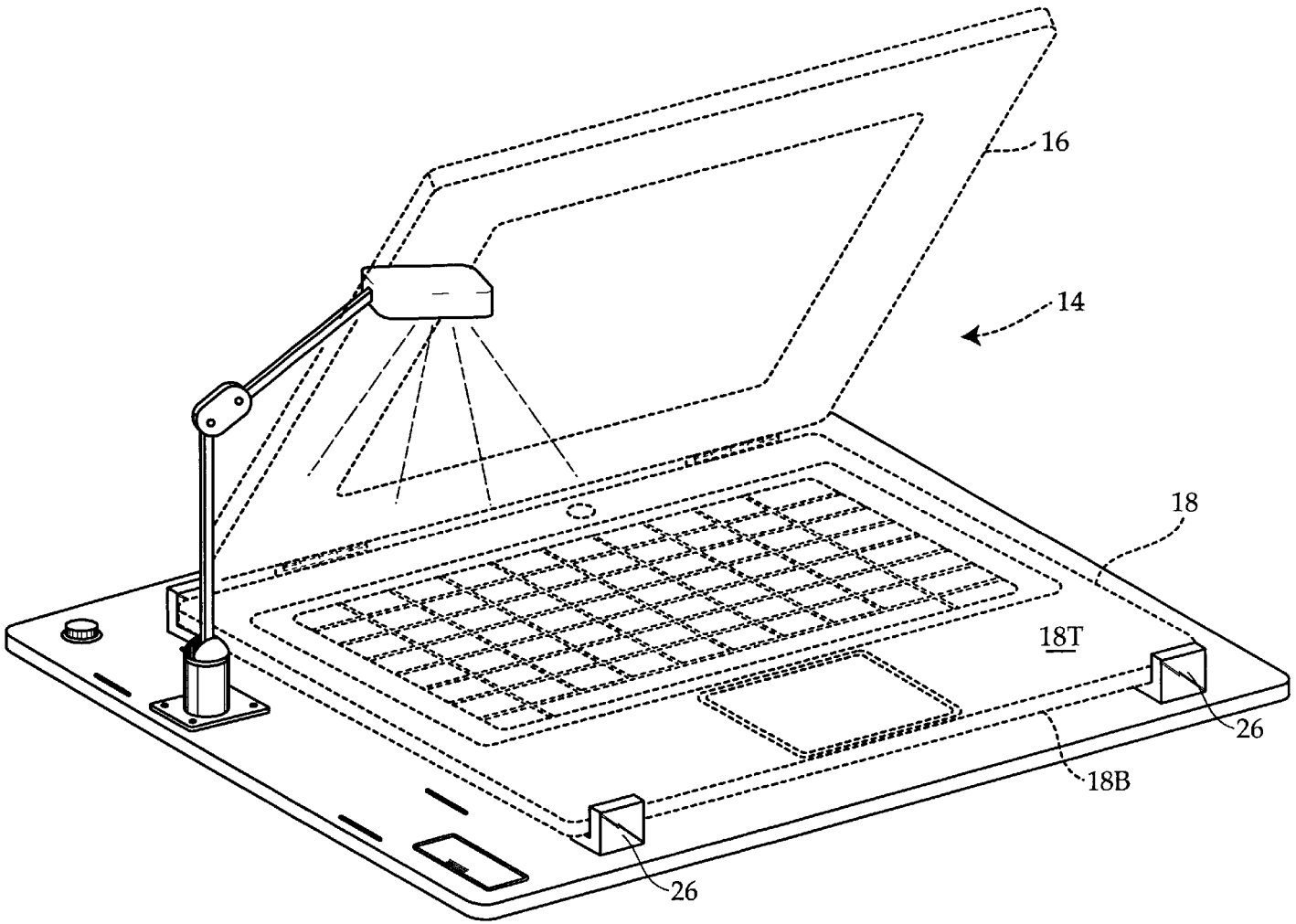
FIG. 5 is a perspective view of the support board with lamp, illustrated a laptop computer in place on the support board, said computer in broken lines.

FIG. 1 illustrates a laptop computer support board with lamp 10 for supporting a laptop computer 14 and providing light thereover. Referring to FIG. 5, the laptop computer 14 generally comprises a screen portion 16 and a keyboard portion 18, wherein the screen portion 16 and the keyboard portion 18 are hingedly connected. The keyboard portion 18 has a top surface 18T on which keys are situated and a bottom surface 18B. The laptop computer support board with lamp 10 essentially comprises a support board 20 on which the keyboard bottom surface 18B rests, a lamp 22, and a vent portion 24 for allowing dispersion of the heat emitted from the computer 14.

The support board 20 has a top surface 20T on which the laptop computer 14 rests, and a bottom surface 20B that is placed on a user's lap or a table top. The board 20 is preferably rectangular in shape in order to accommodate the laptop computer 14. The board 20 has a top edge 20C, a bottom edge 20D, and a pair of side edges 20S. A plurality of stoppers 26 are secured to the board top surface 20T, said stoppers 26 spaced according to the size and shape of the laptop computer 14. Preferably, as illustrated in FIG. 1, the board 20 has four stoppers 26, wherein a pair of opposed stoppers 26 are positioned near one of the board side edges 20S, with one stopper 26 near the top edge 26T and one stopper 26 near the bottom edge 26B. The remaining pair of stoppers 26 are situated near the opposite side edge 26S, with one stopper 26 near the top edge 26T and one stopper 26 near the bottom edge 26B. The stoppers 26 near the board top edge 20C are equidistant from the stoppers 26 near the board bottom edge 20D. However, the stoppers 26 may be removed and repositioned for a particular computer 14 using schemes well known to those of ordinary skill in the art. Thus, when the laptop computer 14 is rested on the support board 20, the computer bottom surface 18B is wedged between the four stoppers 26, thereby raising the computer to facilitate ventilation and minimizing the amount of movement of the computer 14.

The vent portion 24 is positioned between the stoppers 26, said vent portion 24 comprising a plurality of venting holes 28 extending through the board 20 from the top surface 20T to the bottom surface 20B, and a raised platform 30 extending upward from the board top surface 20T. The raised platform 30 slightly elevates the computer 14 above the board top surface 20T, thus leaving additional space for the heat emitted from the computer 14 to escape through the venting holes 28.

The lamp assembly 22 is secured to the board top surface 20T, between one of the board side edges 20S and one pair of stoppers 26. The lamp assembly 22 comprises a mounting plate 32 fixedly secured to the board top surface 20T, an elongated arm 34 extending upward from the mounting plate 32, and a light fixture 36 positioned at an end of the arm opposite the mounting plate 32. The arm 34 has two opposed ends 34A, a bottom portion 34B, a top portion 34T, and a hinge 34H positioned between the bottom and top portions 34B, 34T. The hinge 34H allows the arm top portion 34T to move up and down thereabout. A swivel base 38 extends between the mounting plate 32 and the bottom portion end 34A. This swivel base 38 allows the arm bottom portion 34A to rotate thereabout. Thus, the light fixture 36 can be adjusted in order to provide light over the computer 14.

Figure 3:
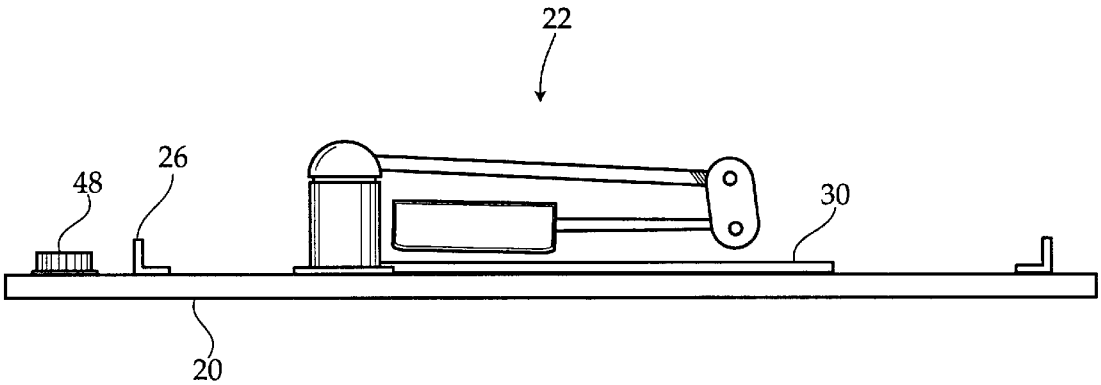
FIG. 3 is a side elevational view of the support board with lamp, illustrating the collapsibility of the lamp assembly.
Figure 4:
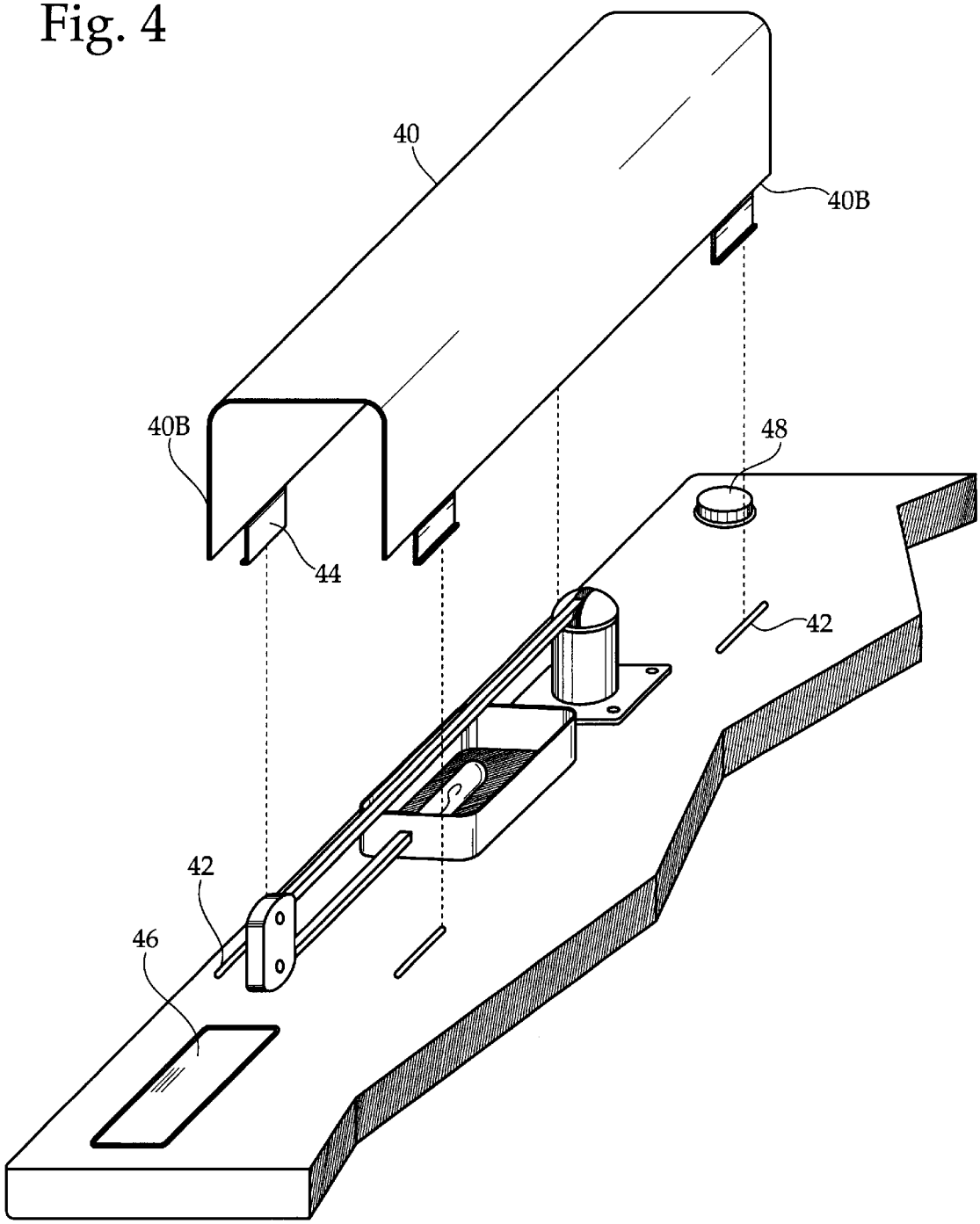
FIG. 4 is a perspective view of a piece of the support board broken away, illustrating the lamp assembly cover.

The lamp assembly 22 is collapsible for easy and convenient storage of the support board 20, as illustrated in FIGS. 3 and 4. Once collapsed, a lamp cover 40 is selectively placed over the lamp assembly 22. A plurality of slots 42 are positioned on both sides of the collapsible lamp assembly 22. The cover 40 is U-shaped, having two parallel bottom edges 40B. A plurality of tabs 44 extend downward from each bottom edge 40B. The number of tabs 44 correspond to the number of slots 42 on the support board 20. The tabs 44 are mateable with the slots 42, thus attaching the cover 40 to the board top surface 20T over the collapsible lamp 22.

The board 20 further comprises a battery compartment 46 for holding batteries, said batteries providing power to the lamp assembly 22, and a lamp assembly power button 48 for controlling the power supplied to the lamp 22. The power button 48 may be configured with a potentiometer so that when it is rotated it regulates the brightness of the light fixture 36.

In conclusion, herein is presented a laptop computer support board with lamp on which the computer rests during use. The invention is illustrated by example in the drawing figures, and throughout the written description. It should be understood that numerous variations are possible, while adhering to the inventive concept. Such variations are contemplated as being a part of the present invention.

What is claimed is:

1. A laptop computer support board with lamp for supporting a laptop computer and providing light thereover, the laptop computer comprises a screen portion and a keyboard portion, the keyboard portion having a bottom surface, comprising:

a support board, the support board having a top surface on which the keyboard bottom surface rests, a bottom surface, a top edge, a bottom edge, a pair of side edges, and two pair of opposed stoppers near each board side edge, with one pair of stoppers near the top edge and one pair of stoppers near the bottom edge, wherein the top edge stoppers are equidistant from the bottom edge stoppers, said stoppers lodging the laptop computer in place atop the board, wherein said stoppers may be spaced according to the size of the laptop computer;

a lamp assembly secured to the board top surface near one of the board side edges, said lamp assembly illuminating the computer screen portion and keyboard portion when the keyboard is positioned on the support board, the lamp assembly comprises a mounting plate fixedly secured to the board top surface, an elongated arm extending upward from the mounting plate, a light fixture positioned at an end of the arm opposite the mounting plate, wherein the elongated arm has two opposed ends, a bottom portion, a top portion, and a hinge positioned between the bottom and top portions, the hinge allowing the arm top portion to move up and down thereabout, said lamp assembly further comprising a swivel base extending between the mounting plate and the arm bottom portion end, the swivel base allowing the arm bottom portion to rotate thereabout; and a vent portion within the support board for allowing dispersion of the heat emitted from the computer, the vent portion comprising a plurality of venting holes extending through the support board, and a raised platform extending around the venting holes and upward from the board top surface; and a lamp cover selectively positionable over the lamp assembly when said lamp assembly is in a collapsed position, the cover being U-shaped and having two parallel bottom edges, each edge having a plurality of flanges extending downward therefrom.

2. The laptop computer support board with lamp as recited in claim 1, wherein the support board top surface comprises a plurality of slots positioned on both sides of the collapsible lamp assembly, wherein the cover flanges are mateable with the slots to secure the cover in place and the number of flanges correspond with the number of slots.

3. The laptop computer support board with lamp as recited in claim 2, wherein the lamp assembly is positioned between one of the board side edges and one pair of stoppers.

4. The laptop computer support board with lamp as recited in claim 3, wherein the vent portion is positioned between the stoppers.

5. The laptop computer support board with lamp as recited in claim 4, wherein the support board is rectangular in shape in order to accommodate the laptop computer.

6. The laptop computer support board with lamp as recited in claim 5, wherein the support board further comprises a battery compartment for holding batteries, said batteries providing power to the lamp assembly.

7. The laptop computer support board with lamp as recited in claim 6, wherein the lamp assembly further comprises a power button for controlling the power supplied to the lamp, the power button being selectively rotatable to regulate the brightness of the light fixture.

* * * * *